US010410488B2

(12) United States Patent
Phillips et al.

(10) Patent No.: US 10,410,488 B2
(45) Date of Patent: Sep. 10, 2019

(54) SECURITY CONNECTOR

(71) Applicant: InVue Security Products Inc., Charlotte, NC (US)

(72) Inventors: Jonathon D. Phillips, Fort Mill, SC (US); Gary A. Taylor, Fort Mill, SC (US); Christopher J. Fawcett, Charlotte, NC (US); Eric Brutke, Tega Cay, SC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 15/523,063

(22) PCT Filed: Oct. 21, 2015

(86) PCT No.: PCT/US2015/056601
§ 371 (c)(1),
(2) Date: Apr. 28, 2017

(87) PCT Pub. No.: WO2016/069344
PCT Pub. Date: May 6, 2016

(65) Prior Publication Data

US 2018/0286196 A1 Oct. 4, 2018

Related U.S. Application Data

(60) Provisional application No. 62/151,650, filed on Apr. 23, 2015, provisional application No. 62/073,730, filed on Oct. 31, 2014.

(51) Int. Cl.
*G08B 13/14* (2006.01)
*H01R 13/627* (2006.01)
(Continued)

(52) U.S. Cl.
CPC ..... *G08B 13/1463* (2013.01); *G08B 13/1445* (2013.01); *H01R 13/6273* (2013.01);
(Continued)

(58) Field of Classification Search
None
See application file for complete search history.

(56) References Cited

U.S. PATENT DOCUMENTS 4,869,248 A * 9/1989 Narula ..... A61B 18/082 606/29
5,567,179 A * 10/1996 Voltz ..... H01R 13/434 439/578
(Continued)

FOREIGN PATENT DOCUMENTS

KR 101507856 B1 4/2015

OTHER PUBLICATIONS

International Search Report and Written Opinion from corresponding International Application No. PCT/US2015/056601, dated Jan. 6, 2016 (7 pages).
(Continued)

*Primary Examiner* — Chico A Foxx
(74) *Attorney, Agent, or Firm* — InVue Security Products Inc.

(57) ABSTRACT

In one example, a connector assembly for providing security to an article of merchandise is provided. The connector assembly includes a cord having a plurality of conductors and a body portion connected to the cord. The connector assembly also includes a connection portion engaged with the body portion and including a plurality of engagement members. Each of the engagement members is electrically connected to a respective conductor in the cord, and the connection portion is configured to engage the article of merchandise to thereby electrically connect the engagement
(Continued)

members to one another for establishing a sense loop through the conductors in the cord. Interruption of the sense loop is indicative of a security event.

32 Claims, 5 Drawing Sheets

(51) Int. Cl.
*H01R 13/66* (2006.01)
*H01R 13/703* (2006.01)
*H01R 24/60* (2011.01)

(52) U.S. Cl.
CPC ..... *H01R 13/6683* (2013.01); *H01R 13/7031* (2013.01); *H01R 24/60* (2013.01)

(56) References Cited

U.S. PATENT DOCUMENTS 5,821,868 A * 10/1998 Kuhling ..... G08B 13/1418 340/649
6,022,239 A * 2/2000 Wright ..... H01R 13/6273 439/354
6,077,122 A * 6/2000 Elkhatib ..... H01R 13/5804 439/417
7,363,947 B2 4/2008 Teicher
8,517,748 B1 8/2013 Kelsch et al.
8,696,377 B2 4/2014 Kelsch et al.
8,845,356 B2 9/2014 Cheatham et al.
2012/0295462 A1* 11/2012 Villarreal ..... H01R 13/6275 439/304
2013/0194096 A1* 8/2013 Belden, Jr. ..... G08B 13/1463 340/568.4
2013/0196530 A1* 8/2013 Cheatham ..... H01R 13/62 439/357
2013/0217253 A1* 8/2013 Golko ..... H01R 13/516 439/345
2014/0335730 A1 11/2014 Grant et al.
2015/0287299 A1* 10/2015 Eckert ..... G08B 13/1418 340/568.2

OTHER PUBLICATIONS

Examination Report from corresponding United Kingdom Patent Application No. GB1708038.3, dated Jun. 13, 2018 (5 pages).

* cited by examiner

SECURITY CONNECTOR

CROSS REFERENCE TO RELATED APPLICATIONS

The present application claims priority to U.S. Provisional Application No. 62/073,730, filed Oct. 31, 2014, and U.S. Provisional Application No. 62/151,650, filed Apr. 23, 2015, the contents of which are each incorporated by reference herein in their entirety.

FIELD OF THE INVENTION

Embodiments of the present invention relate generally to connectors for electronic devices, including connectors for securing electronic devices from theft.

BACKGROUND OF THE INVENTION

Retailers routinely display articles of merchandise, such as portable computers (e.g. notebooks, laptops, tablets, etc.), mobile phones, e-readers, media players, and the like for customers to evaluate before making a purchase. These articles of merchandise are continually being made smaller and lighter in weight due to advances in technology and materials. As a result, such merchandise is increasingly vulnerable and susceptible to theft. At the same time, the retail price and profit margin for such merchandise continues to decline. Accordingly, these articles of merchandise need to be secured by a security device that effectively and cost efficiently protects the merchandise from theft.

It is common in the retail security industry to have electronic devices tethered to a store fixture to prevent theft yet allow a customer to interact with the device. In addition, it is desirable to provide power to the electronic device so that the device may be charged and operable for use by a potential customer, while at the same time providing security to an electronic device.

BRIEF SUMMARY OF THE INVENTION

Embodiments of the present invention are directed to a connector assembly for providing security to an article of merchandise. The connector assembly includes a cord comprising a plurality of conductors and a body portion connected to the cord. The connector assembly also includes a connection portion engaged with the body portion. The connection portion comprises a plurality of engagement members and a conductive shield. Each of the engagement members is electrically connected to a respective conductor in the cord and is electrically isolated from the conductive shield. The connection portion is configured to engage the article of merchandise to thereby electrically connect the engagement members to one another for establishing a sense loop through the conductors in the cord, and interruption of the sense loop is indicative of a security event.

In another embodiment a security system for securing an article of merchandise from theft is provided. The security system comprises a connector configured to engage an article of merchandise. The connector comprises a plurality of engagement members and a conductive shield. The security system also includes a cord comprising a plurality of conductors. The connector is connected to the cord. The security system further includes a monitoring device operably engaged with the cord and configured to generate a security signal in response to a security event. Each of the engagement members is electrically connected to a respective conductor in the cord and is electrically isolated from the conductive shield. The connector is configured to engage the article of merchandise to thereby electrically connect the engagement members to one another for establishing a sense loop through the conductors in the cord, and wherein interruption of the sense loop is indicative of a security event.

According to another embodiment, a method for securing an article of merchandise from theft is provided. The method includes providing: a connector comprising a plurality of engagement members and a conductive shield; a cord comprising a plurality of conductors, the connector connected to the cord; and a monitoring device operably engaged with the cord and configured to generate a security signal in response to a security event, wherein each of the engagement members is electrically connected to a respective conductor in the cord and is electrically isolated from the conductive shield. The method further includes engaging the article of merchandise with the connector to thereby electrically connect the engagement members to one another for establishing a sense loop through the conductors in the cord, wherein interruption of the sense loop is indicative of a security event.

DETAILED DESCRIPTION OF EMBODIMENTS OF THE INVENTION

Figure 1:
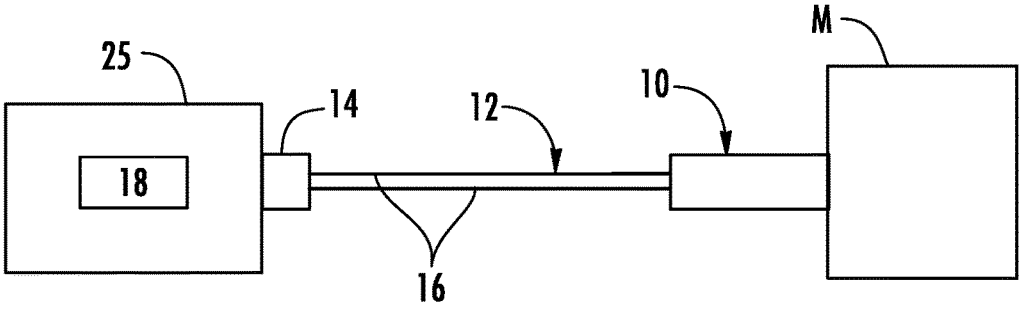
FIG. 1 is a schematic of a security system according to one embodiment of the present invention.

Embodiments of the present invention will now be described more fully hereinafter with reference to the accompanying drawings, in which exemplary embodiments of the invention are shown. This invention may, however, be embodied in many different forms and should not be construed as limited to the embodiments set forth herein. Rather, the exemplary embodiments are provided so that this disclosure will be thorough and complete, and will fully convey the scope of the invention to those skilled in the art.

Reference will now be made to the accompanying drawing figures wherein identical reference numerals denote the same or similar elements throughout the various views. One or more embodiments of a connector 10 for securing an article of merchandise "M" from theft are described below. The article of merchandise M may be a display model or an operational sample of electronic merchandise, such as portable computers (e.g. notebooks, laptops, tablets, etc.), e-readers, mobile phones, smart phones, media players, and the like, for a customer to examine before making a decision to purchase the item. The article of merchandise M may be typically displayed in a manner that permits a prospective purchaser to evaluate the operation and features of the merchandise, while protecting the merchandise from a potential thief. A power cord or tether 12 may be operably engaged with the article of merchandise M at one end, and according to one embodiment, a security event (e.g., removal, cutting, or tampering of the power cord) may result in the generation of a security signal (e.g., an audible and/or visual alarm).

For example, the power cord 12 may be operably engaged with a monitoring device 25 configured to generate a security signal upon detecting a security event. In one embodiment, the power cord 12 includes a connector 14 configured to operably engage a monitoring device 25 (see, e.g., FIG. 1). The power cord 12 may electrically connect the monitoring device 25 to the article of merchandise M. Thus, upon the occurrence of a security event, the monitoring device 25 may include circuitry for detecting the security event and generating an appropriate security signal. For example, the monitoring device 25 may be similar to those manufactured by InVue Security Products Inc. In another example, the monitoring device 25 may include a display module or sensor configured to removably support the article of merchandise M, as well as provide power and security to the article of merchandise. According to some embodiments, the monitoring device 25 may be similar to those disclosed in U.S. Pat. Nos. 7,710,266, entitled Security System with Product Power Capability and issued May 4, 2010, and U.S. Pat. No. 7,727,843, entitled Programmable Alarm Module and System for Protecting Merchandise and issued Jun. 15, 2010, each of which is incorporated by reference herein in its entirety. The monitoring device 25 could be any other suitable device, such as a sensor. The sensor could be in communication with a display module or stand that is configured to generate a security signal. Moreover, the monitoring device 25 could be integrated with an input power source or controller 18, such as for providing and/or receiving power and/or security signals from the connector 10 and/or the article of merchandise M.

Embodiments of the present invention provide for the delivery of at least power to the article of merchandise M on display through a power cord 12, cable, or the like. The power cord 12 may include a plurality of conductors 16. For example, a pair of conductors 16 in the power cord 12 (e.g., a positive power line and a ground line) may provide power to the article of merchandise M. An input power source or controller 18 may be in electrical communication with the power cord for transmitting power and other signals through the cord 12 and to the article of merchandise M. The power cord 12 may include additional conductors 16 if desired, such as for transmitting data, audio, video, optical and/or communication signals. Moreover, in one embodiment, the power cord 12 includes at least one conductor 16 for transmitting a security signal. For example, the power cord 12 may include a plurality of conductors 16, one of which for transmitting a signal to the connector 10, and a second conductor for returning the signal back through the power cord. Should the signal be disrupted (e.g., the cord 12 is removed or cut), a security signal may be generated. For instance, an audible and/or a visible signal may be generated. In addition, the functionality of the article of merchandise M may be interrupted and locked from further use without being overridden by an authorized user, such as by inputting a passcode or using an appropriate key.

One end of the power cord 12 includes a connector 10 configured to electrically couple to the article of merchandise M. The opposite end of the power cord 12 is configured to be coupled to a power source 18, such as a USB-port on another electronic device or an electrical outlet. Thus, the power cord 12 may include a USB connector or the like that is electrically connected to the connector 10 at the opposite end of the cord. In other embodiments, the power cord 12 may be electrically coupled to a monitoring device 25, as explained above. The connector 10 is configured to provide at least power and security signals to the article of merchandise.

Figure 2:
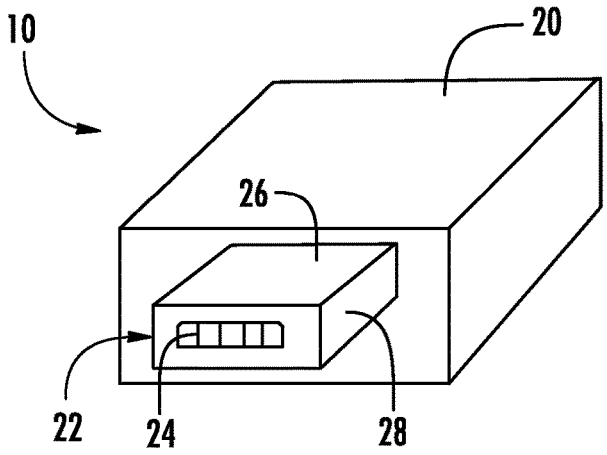
FIG. 2 is a perspective view of a connector according to an embodiment of the present invention.
Figure 3:
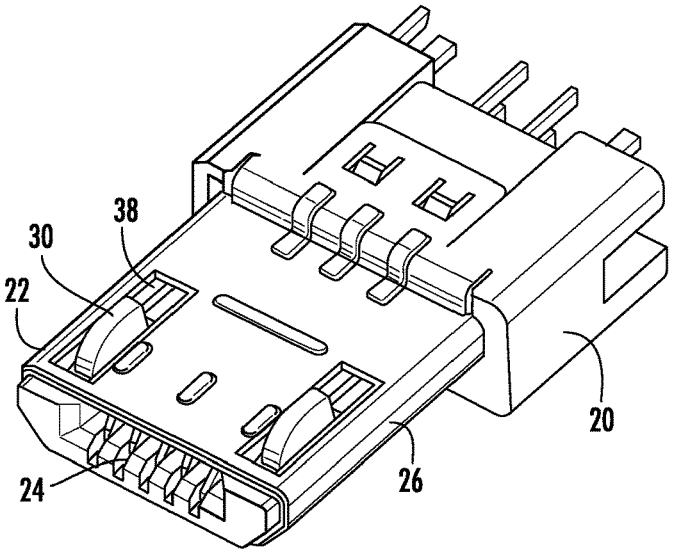
FIG. 3 is a perspective view of a connector according to an embodiment of the present invention.
Figure 4:
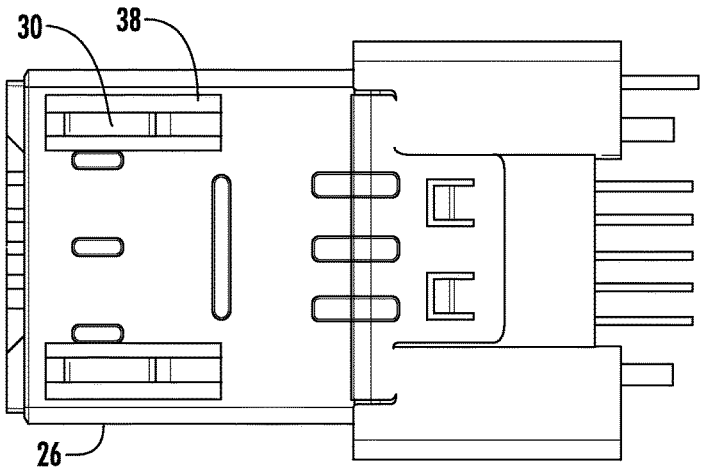
FIG. 4 is a plan view of the connection shown in FIG. 3.
Figure 5:
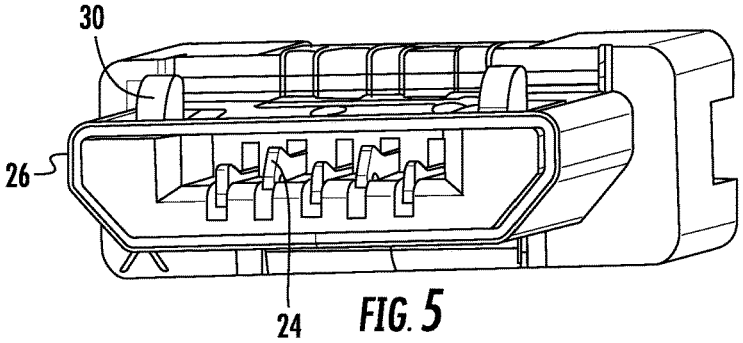
FIG. 5 is an end perspective view of the connector shown in FIG. 3.

Generally, the connector 10 may include a body portion 20 and a connection portion 22 extending outwardly therefrom (see, e.g., FIG. 2). The body portion 20 and connection portion 22 may be separate members coupled to one another or integrally formed as a single component. Although the body portion 20 and the connection portion 22 may be various sizes and configurations, the connection portion is illustrated as having a smaller cross-sectional dimension than the body portion. The power cord 12 is coupled to the body portion 20, while the connection portion 22 is configured to be inserted within an input port 40 of the article of merchandise M so as to be electrically connected thereto. The body portion 20 may be hard wired to the power cord 12 or connected using a suitable releasable coupling. The connection portion 22 comprises a plurality of conductors 24, contacts, or pins that correspond to one or more of the conductors 16 in the power cord, as discussed above. The connection portion 22 may include any number of conductors 24, such as 2, 4, 6, 8, etc. The conductors 24 may be disposed, embedded, or otherwise integrated with a conductive shield 26. Thus, the shield 26 may surround the conductors 24 and form an outer surface of the connection portion 22. The shield 26 may surround the conductors 24 and include a conductive material. The connection portion 22 may include one or more engagement members 30 (e.g., locking tines) that facilitate engagement with corresponding engagement members 42 in the input port of the article of merchandise M (see, e.g., FIGS. 3 and 7). The engagement members 30 may be electrically isolated from the conductive shield 26 when the connector is engaged with the article of merchandise. In some embodiments, the connector 10 is similar to a USB connector, such as a USB-A, micro-USB, or a USB-C connector, although other types of connectors may be employed.

As noted above, the power cord 12 may include a plurality of conductors 16, one of which is for transmitting a signal to the connector 10 (e.g., via a first conductor), and a second conductor for returning the signal back through the power cord (e.g., via a ground conductor) thereby forming a sense loop. As long as the connector 10 is electrically connected to the article of merchandise M, the sense loop through one conductor and the ground conductor is uninterrupted. Should the sense loop be disrupted (e.g., the cord 12 is removed or cut), a security signal may be generated. Thus, as soon as the connector 10 is removed from the article of merchandise M, the shorted conductors would open, resulting in the generation of a security signal. The connector 10 may also include a conductor that allows power to be provided to the connector, which may be used to provide power to the article of merchandise M. Thus, the article of merchandise M may be charged via the connector 10.

The input port 40 of the article of merchandise M may include a plurality of conductors, pins, contacts, or pads 44 that are configured to electrically connect to corresponding conductors 24 on the connection portion 22, engagement members 30, and/or conductive shield 26 when the connection portion is engaged with the input port. In one embodiment, the input port 40 includes a plurality of conductors 44 that are configured to electrically connect to the conductors 24, engagement members 30, and/or the conductive shield 26 of the connector. For example, the input port 40 may include a conductive shield that is configured to electrically connect to the engagement members 30 when the connection portion 22 is engaged with the article of merchandise (see, e.g., FIG. 7). As such, coupling the connector 10 with the input port 40 results in each of the engagement members 30 of the connector to be in electrical communication with one another via the conductive shield of the input port. In order to establish a sense loop, one of the engagement members 30 may be electrically connected to one conductor 16 in the power cord 12, while another engagement member is electrically connected to another conductor in the power cord (see, e.g., FIG. 6). In some cases, the engagement members 30 may be larger than conventional engagement members found on a micro-USB connector to ensure contact with the conductive shield of the input port 40, and/or the openings 38 through which the engagement members extend may be larger than the openings in conventional micro-USB connectors. For example, the height of each engagement member 30 above the conductive shield 26 (linear distance measured from the outer surface of the conductive shield 26) and/or length of the engagement member extending above the conductive shield (linear distance measured along the conductive shield) may be up to about 15% larger than conventional micro-USB connectors. In another example, the width of each opening 38 (linear distance perpendicular to the engagement member) may be about 0.5 mm larger than conventional openings defined in the conductive shield 26.

Thus, when not in engagement with the article of merchandise, the engagement members 30 will not be electrically connected with one another. However, when the connection portion 22 is inserted in the input port 40 of the article of merchandise, the electrical connection with the conductive shield in the input port electrically connects the engagement members 30 thereby establishing a sense loop through a first conductor 16 in the power cord 10, a first engagement member 30, the conductive shield in the input port 40, a second engagement member, and a second conductor in the power cord. As noted above, the monitoring device 25 may be configured to sense an interruption in the sense loop for generating a security signal, such as removal of the connection portion 22 or cutting the power cord 12.

Figure 6:
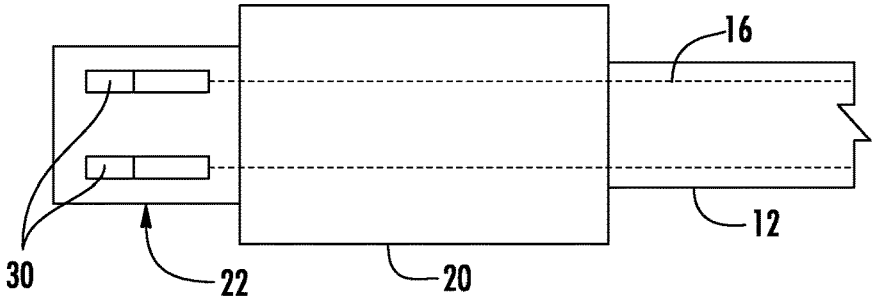
FIG. 6 is a plan view of a connector according to one embodiment of the present invention.
Figure 7:
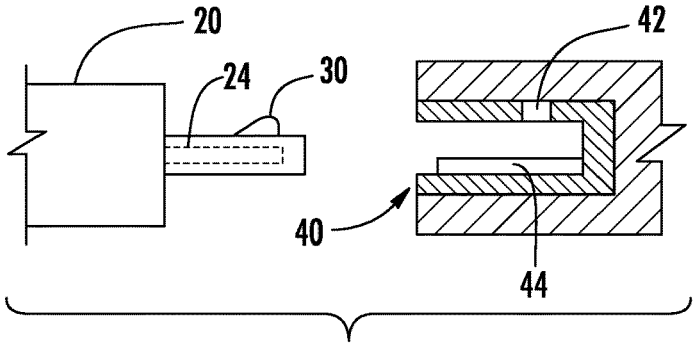
FIG. 7 is a side view of a connector and an input port of an article of merchandise according to an embodiment of the present invention.

In some cases and a variation of the embodiment shown in FIGS. 6-7, another conductor 16 of the power cord 12 may be electrically connected to the conductive shield 26. In this regard, each of the engagement members 30 may be configured to independently electrically connect to the conductive shield in the input port 40 and the conductive shield 26. Thus, a sense loop may be formed between the conductor connected to the conductive shield 26 and a conductor electrically connected to each of the engagement members 30 when the conductive shield in the input port 40 contacts the engagement members and the conductive shield 26.

Figure 8:
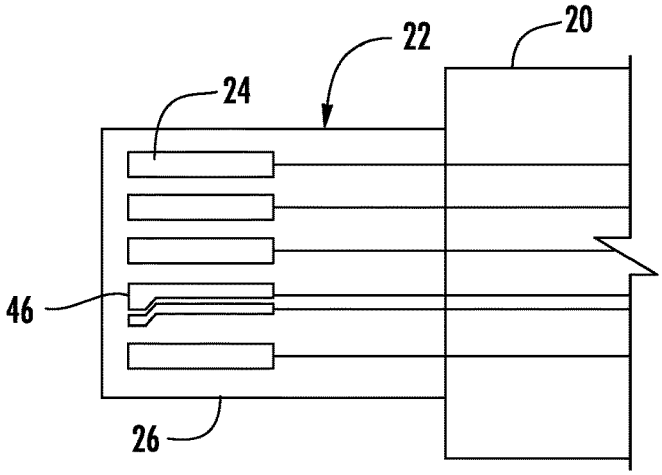
FIG. 8 is a plan view of a connector according to an embodiment of the present invention.

In another embodiment, a sense loop may be established using one or more ID conductors or pins 46 in the connector 10 (see, e.g., FIG. 8). For example, a sense loop could be established over an ID pin in the connector when engaged with a corresponding ID conductor or pad in the input port 40. In this regard, the ID pin 46 in the connector may be separated into two components that are not electrically connected to one another when the connector is not engaged with the article of merchandise. The two components may be configured to bias into engagement with one another when the connection portion 22 is inserted into the input port 40. Each of the two components may be electrically connected to a respective conductor 16 in the power cord 12 such that a sense loop is established through the conductors in the power cord, the two components of the ID pin 46, and the ID pad. Because the ID pins and ID pad are electrically connected to respective conductors 16 in the power cord, a sense loop is established when the connector is connected to the article of merchandise.

In one embodiment, the connector may include a sensor or switch configured to complete a sense loop when the connector is inserted into the input port of the article of merchandise. The switch may operate in a similar manner as the ID pin 46 being separated into two components. For example, a switch may be provided on the ID pin 46 of the connector. The switch may be configured to be biased to a closed position when the connection portion 22 is inserted within the input port 40 of the article of merchandise. The ID pin 46 may be electrically connected to a pair of conductors 16 extending through the power cord 12 that are configured to complete a sense loop when the switch is closed. If the connector is removed in an unauthorized manner, the sense loop is interrupted, and a security signal may be generated by the alarm unit 25.

Figure 9:
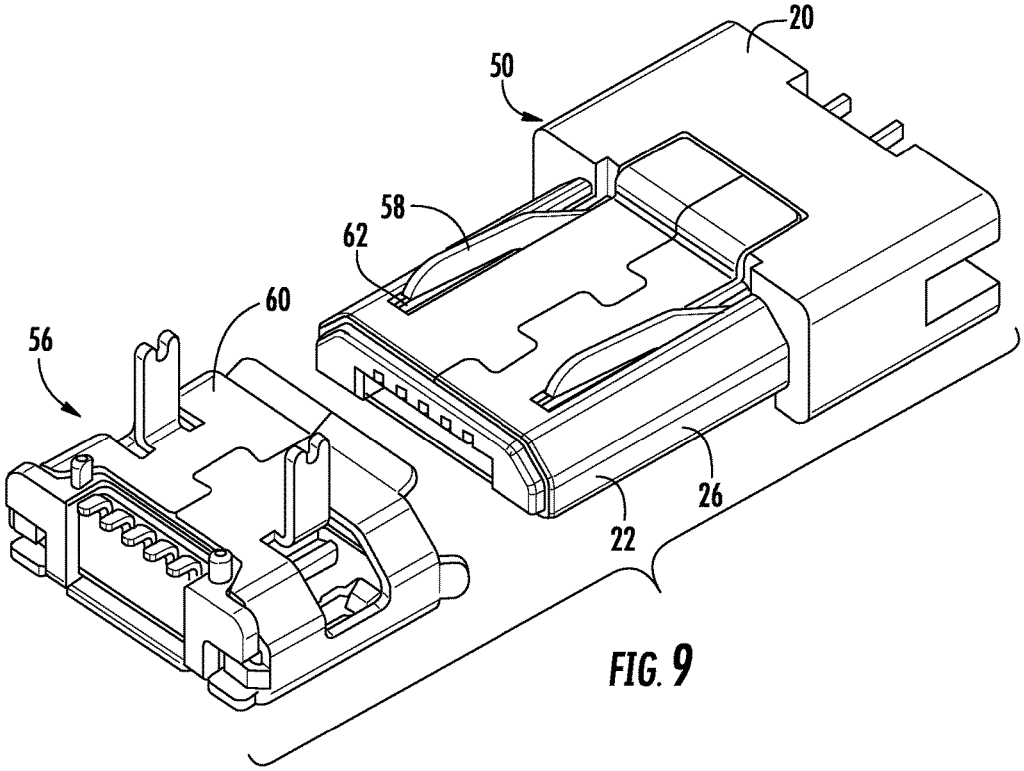
FIG. 9 is a perspective view of a connector according to another embodiment of the present invention.
Figure 10:
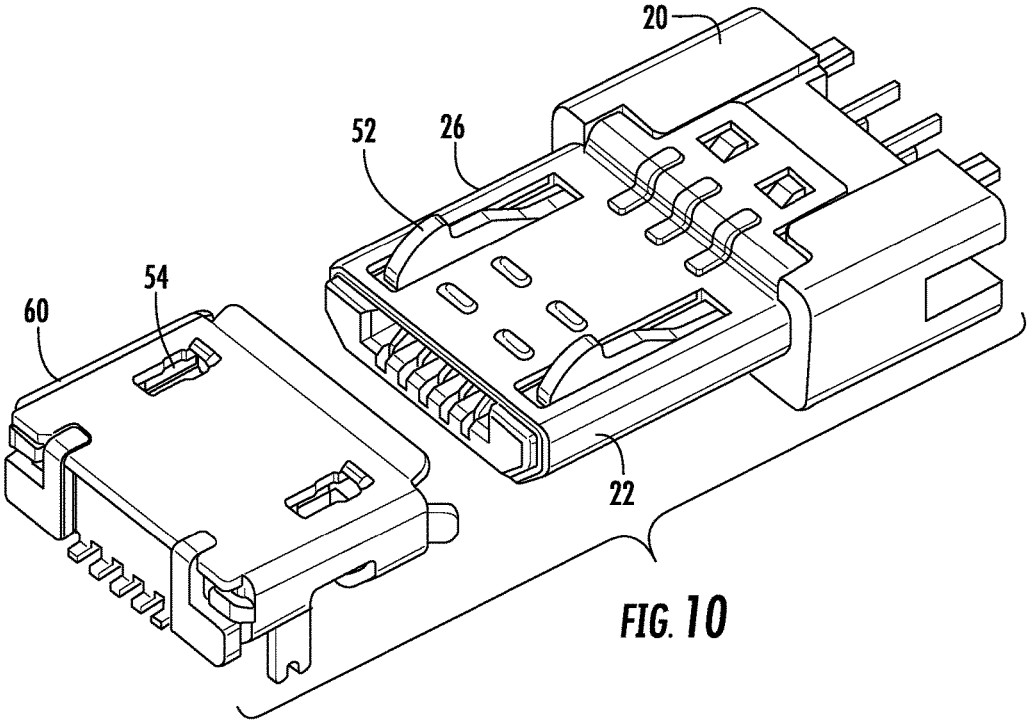
FIG. 10 is another perspective view of the connector shown in FIG. 9.
Figure 11:
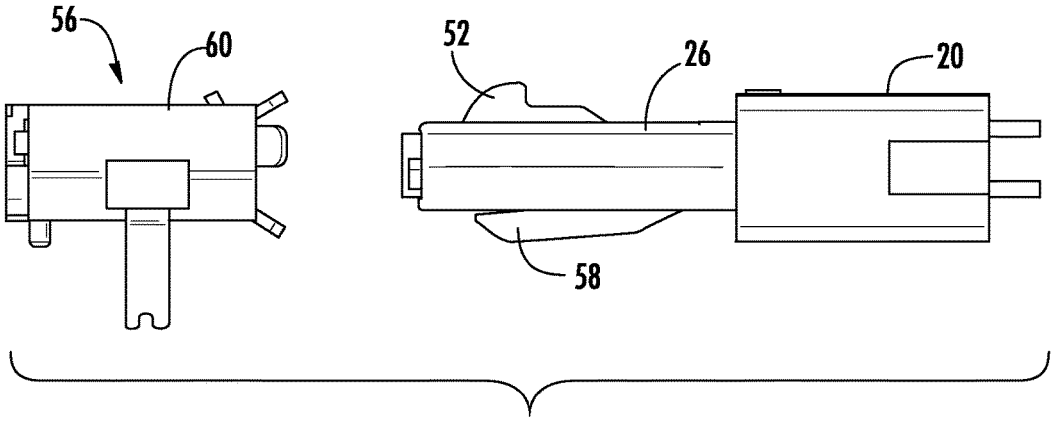
FIG. 11 is a side view of the connector shown in FIG. 9.

FIGS. 9-11 show another embodiment of a connector 50. In this embodiment, one surface of the connector 50 includes one or more engagement members 52 for engaging corresponding engagement members 54 associated with the input port 56 of the article of merchandise M. Thus, the engagement members 52, 54 facilitate a mechanical attachment between the connector 50 and the article of merchandise M. On an opposite side of the connector 50, one or more additional engagement members 58 are provided. The illustrated embodiment shows a pair of engagement members 58. The engagement members 58 are used to define a sense loop similar to that discussed above. In this regard, the engagement members 58 are configured to engage the input port 56 when the connector 50 is inserted therein. The engagement members 58 may be any desired shape configured to result in such engagement with the input port 56. The engagement members 58 may be configured to bias outwardly from an outer surface of the connector so as to facilitate a mechanical and an electrical engagement with the input port 56. The conductive shield 26 may define corresponding slots or openings 62 configured to receive a respective engagement member 58 and allow the same to move inwardly and outwardly relative to the outer surface of the conductive shield, as well as maintain electrical isolation between the conductive shield and the engagement members 58. The engagement members 58 may be formed of a conductive material such that engagement with the conductive shield of the input port 56 forms a sense loop between the engagement members 58 and the input port. In this regard, when not in engagement with the input port 56, the engagement members 58 will not be electrically connected with one another. However, when the connection portion 22 is inserted in the input port 56 of the article of merchandise, the electrical connection with the conductive shield in the input port electrically connects the engagement members 58 thereby establishing a sense loop. The engagement members 58 may be electrically connected to respective conductors 16 for defining a sense loop through a power cord 12 as also discussed above. Thus, a sense loop may be defined through one of the conductors 16, one of the engagement members 58, the conductive shield of the input port 56, the other of the engagement members 58, and the other conductor 16. In this way, the conductive shield 26 does not form or otherwise define any part of the sense loop.

Embodiments of the present invention provide advantages over similar connectors that may otherwise be incapable of providing security to the article of merchandise. This functionality is advantageous in a retail environment where articles of merchandise are on display for inspection by a customer. Some conventional connectors do not enable a security signal to be transmitted through the connector since the ground conductor is not connected to the conductive shield, which prevents a sense loop from being formed between the ground conductor and the conductive shield. Thus, a sense loop is not possible with some current connector designs since there is no means to detect an interruption in the sense loop.

The foregoing has described one or more embodiments of a connector for securing an article of merchandise from theft. Those of ordinary skill in the art will understand and appreciate that numerous variations and modifications of the invention may be made without departing from the spirit and scope of the invention. Accordingly, all such variations and modifications are intended to be encompassed by the appended claims.

That which is claimed is:

1. A connector assembly for providing security to an article of merchandise, the connector assembly comprising:

a cord comprising a plurality of conductors;

a body portion connected to the cord;

a connection portion engaged with the body portion, the connection portion comprising a plurality of conductive members and a conductive shield, the conductive members being at least partially disposed within the conductive shield and configured to be inserted within an input port of the article of merchandise;

wherein each of the conductive members is electrically connected to at least one conductor in the cord and is electrically isolated from the conductive shield;

wherein the conductive shield is configured to be inserted within the input port to engage the article of merchandise to thereby electrically connect the conductive members to one another for establishing a sense loop through the conductors in the cord, and wherein interruption of the sense loop is indicative of a security event.

2. The connector assembly according to claim 1, wherein at least a pair of the plurality of conductors in the cord are configured to transmit power between the connector and the article of merchandise.

3. The connector assembly according to claim 1, wherein the connector is a USB connector.

4. The connector assembly according to claim 1, wherein the connector is a micro-USB connector.

5. A connector assembly according to claim 1, wherein the cord is configured to operably engage a monitoring device for generating a security signal in response to a security event.

6. The connector assembly according to claim 1, wherein the conductive members comprise a pair of locking tines configured to engage the input port of the article of merchandise.

7. The connector assembly according to claim 1, wherein the conductive members comprise a pair of biasing members on one side of the connection portion configured to bias outwardly into engagement with the input port of the article of merchandise for establishing an electrical connection.

8. The connector assembly according to claim 7, further comprising a pair of conductive members on an opposite side of the connection portion configured to mechanically engage the input port of the article of merchandise.

9. The security system according to claim 1, wherein the conductive members comprise a pair of biasing members configured to bias outwardly into engagement with the input port of the article of merchandise for establishing an electrical connection.

10. The security system according to claim 9, further comprising a pair of conductive members opposite the pair of biasing members and configured to mechanically engage the input port of the article of merchandise.

11. The connector assembly according to claim 1, wherein each of the conductive members is electrically connected to a respective conductor in the cord.

12. The connector assembly according to claim 1, wherein the conductive shield is electrically connected to at least one of the conductors in the cord.

13. The connector assembly according to claim 1, wherein the conductive members are a pair of conductive members configured to be biased in response to insertion of the conductive shield into the input port of the article of merchandise for establishing an electrical connection.

14. The connector assembly according to claim 1, wherein the conductive members are configured to electrically connect to the input port of the article of merchandise for establishing a sense loop through the conductors in the cord.

15. The connector assembly according to claim 1, wherein the conductive members are not electrically connected to one another when the conductive shield is not engaged with the input port of the article of merchandise.

16. The connector assembly according to claim 1, wherein each of a pair of the plurality of the conductive members are electrically connected to a respective conductor in the cord and are electrically isolated from the conductive shield, and wherein the pair of the conductive members are electrically isolated from each other.

17. A security system for securing an article of merchandise from theft, the security system comprising:

a connector configured to engage an input port of an article of merchandise, the connector comprising a plurality of conductive members and a conductive shield, the conductive members being at least partially disposed within the conductive shield and configured to be inserted within the input port of the article of merchandise;

a cord comprising a plurality of conductors, the connector connected to the cord;

a monitoring device operably engaged with the cord and configured to generate a security signal in response to a security event, wherein each of the conductive members is electrically connected to at least one conductor in the cord and is electrically isolated from the conductive shield, wherein the conductive shield is configured to be inserted within the input port to engage the article of merchandise to thereby electrically connect the conductive members to one another for establishing a sense loop through the conductors in the cord, and wherein interruption of the sense loop is indicative of a security event.

18. The security system according to claim 17, wherein at least a pair of the plurality of conductors in the cord are configured to transmit power between the connector and the article of merchandise.

19. The security system according to claim 17, wherein the connector is a USB connector.

20. The security system according to claim 17, wherein the connector is a micro-USB connector.

21. The security system according to claim 17, wherein the conductive members comprise a pair of locking tines configured to engage the input port of the article of merchandise.

22. The security system according to claim 17, wherein each of the conductive members is electrically connected to a respective conductor in the cord.

23. The security system according to claim 17, wherein the conductive members are a pair of conductive members configured to be biased in response to insertion of the conductive shield into the input port of the article of merchandise for establishing an electrical connection.

24. The security system according to claim 17, wherein the conductive members are configured to electrically connect to the input port of the article of merchandise for establishing a sense loop through the conductors in the cord.

25. The security system according to claim 17, wherein the conductive members are not electrically connected to one another when the connector is not engaged with the input port of the article of merchandise.

26. The security system according to claim 17, wherein each of a pair of the plurality of the conductive members are electrically connected to a respective conductor in the cord and are electrically isolated from the conductive shield, and wherein the pair of the conductive members are electrically isolated from each other.

27. A method for securing an article of merchandise from theft, the method comprising:

providing: a connector comprising a plurality of conductive members and a conductive shield, the conductive members being at least partially disposed within the conductive shield and configured to be inserted within an input port of the article of merchandise; a cord comprising a plurality of conductors, the connector connected to the cord; and a monitoring device operably engaged with the cord and configured to generate a security signal in response to a security event, wherein each of the conductive members is electrically connected to at least one conductor in the cord and is electrically isolated from the conductive shield; and inserting the conductive shield within the input port of the article of merchandise to thereby electrically connect the conductive members to one another for establishing a sense loop through the conductors in the cord, wherein interruption of the sense loop is indicative of a security event.

28. The method according to claim 27, wherein each of the conductive members is electrically connected to a respective conductor in the cord.

29. The method according to claim 27, wherein inserting comprises inserting the conductive shield within the input port of the article of merchandise to cause a pair of the conductive members to bias and thereby electrically connect the pair of conductive members to one another.

30. A connector assembly for providing security to an article of merchandise, the connector assembly comprising:

a cord comprising a plurality of conductors;

a body portion connected to the cord;

a connection portion engaged with the body portion, the connection portion comprising a plurality of conductive members and a conductive shield, the conductive members being at least partially disposed within the conductive shield and configured to be inserted within an input port of the article of merchandise;

wherein each of a pair of the plurality of the conductive members are electrically connected to a respective conductor in the cord and are electrically isolated from the conductive shield, wherein the pair of the conductive members are electrically isolated from each other;

wherein the conductive shield is configured to be inserted within the input port to engage the article of merchandise to thereby electrically connect the pair of conductive members to one another for establishing a sense loop through the conductors in the cord, and wherein interruption of the sense loop is indicative of a security event.

31. The connector assembly according to claim 30, wherein the pair of conductive members are engagement members configured to mechanically engage the input port of the article of merchandise.

32. The connector assembly according to claim 30, wherein the pair of conductive members are pins configured to mechanically engage one another in response to insertion of the conductive shield within the input port of the article of merchandise.

* * * * *